US006438933B1

(12) United States Patent
Watanabe et al.

(10) Patent No.: US 6,438,933 B1
(45) Date of Patent: Aug. 27, 2002

(54) THREADING APPARATUS AND THREADING METHOD IN A TEXTILE MACHINE

(75) Inventors: Tetsuya Watanabe; Shunzo Naito; Yoshihide Nishimura, all of Matsuyama (JP)

(73) Assignee: Teijin Seiki Co., Ltd., Tokyo (JP)

( * ) Notice: Subject to any disclaimer, the term of this patent is extended or adjusted under 35 U.S.C. 154(b) by 0 days.

(21) Appl. No.: 09/806,238

(22) PCT Filed: Oct. 18, 1999

(86) PCT No.: PCT/JP99/05726

§ 371 (c)(1),
(2), (4) Date: Mar. 28, 2001

(87) PCT Pub. No.: WO00/26451

PCT Pub. Date: May 11, 2000

(30) Foreign Application Priority Data

Oct. 31, 1998 (JP) ..... 10-325856
Jun. 11, 1999 (JP) ..... 11-165042

(51) Int. Cl.[7] ..... D02G 1/00
(52) U.S. Cl. ..... 57/280; 57/284
(58) Field of Search ..... 28/247, 249, 253, 28/271, 272; 57/328–351, 279, 280, 284–292

(56) References Cited

U.S. PATENT DOCUMENTS 3,999,360 A 12/1976 Forin et al.
4,332,132 A * 6/1982 Bru et al. ..... 57/280
5,671,519 A * 9/1997 Naylor ..... 28/249

FOREIGN PATENT DOCUMENTS

| | | |
|---|---|---|
| FR | 2 380 972 A | 10/1978 |
| JP | 60-21931 A | 2/1985 |
| JP | 8-74136 A | 3/1996 |
| JP | 10-317238 A | 12/1998 |

* cited by examiner

*Primary Examiner*—Danny Worrell
*Assistant Examiner*—Shaun R Hurley
(74) *Attorney, Agent, or Firm*—Rothwell, Figg, Ernst & Manbeck

(57) ABSTRACT

An apparatus and method for threading a yarn onto a draw texturing machine comprising a main frame (20) provided with twisting devices (5) and second heaters (13) and a winding frame (22) provided with winding devices (10) are disposed sandwiching an operator's aisle (21) therebetween. A yarn (Y) leaving the second heater is guided along the operator's aisle to the winding device mounted on the winding frame. The second heater (13) has a yarn threading slit (13*a*) formed therein, and a guiding pipe (34) having a spiral cross section and yarn disengaging slit (34*a*) formed therein is disposed adjacent to the yarn threading slit (13*a*). Along the operator's aisle (21), an extendable yarn guide pipe (41) and a fourth movable yarn feed roller device (7) are disposed. A yarn feed tube (51) provided with a yarn feed nozzle (51*a*) is disposed between the extended end of the yarn guide pipe (41) and the winding device (10). The apparatus and method of the invention allows an operator to thread the yarn around the operator's aisle without bending.

14 Claims, 9 Drawing Sheets

(a)

(b)

THREADING APPARATUS AND THREADING METHOD IN A TEXTILE MACHINE

TECHNICAL FIELD TO WHICH THE INVENTION RELATES

The present invention relates to a threading apparatus and a threading method in a textile machine. More specifically, the present invention relates to a threading apparatus and a threading method by which threading operation from a twisting device to a winding device can be done easily in a textile machine, such as a draw false-twist texturing machine.

BACKGROUND ART

In a false-twist texturing machine or a draw false-twist texturing machine, a yarn supplied from a supply package on a creel is fed by means of a first feed roller, while twists imparted by a twisting device disposed downstream and run back along the yarn are heat set by means of a first heater disposed between the first feed roller and the twisting device, and the yarn is cooled at a stabilizing zone locating downstream of the first heater and is detwisted at the twisting device, and then the yarn is fed by means of a second feed roller and is wounded. In many cases, leaving the second roller, the yarn passes through a second heater and, if desired, through a third feed roller, and it is fed to the winding device.

In such a false-twist texturing machine or a draw false-twist texturing machine, known is a textile machine comprising: a main frame provided with twisting devices and second heaters; a winding frame provided with winding devices facing and spacing from the main frame; and an operator's aisle disposed between the main frame and the winding frame. The yarn leaving the second heater passes beneath the operator's aisle and is fed to the winding device.

When such a construction as described above wherein an operator's aisle is disposed between the main frame and the winding frame is used, a so called individual doffing mechanism by which doffing operation from the winding parts of the winding frame is done for individual spindles can be readily disposed, and thus, while the threading operation can be done at the side facing the operator's aisle, the fully wound packages can be doffed from the side opposite to the operator's aisle.

Further, when the first heater is a heater which can be heated to a high temperature higher than 400° C., since the heater length of the first heater can be relatively shortened, the yarn passage in the heating zone can be brought into a condition like a straight line by the application of such a separate construction of the main frame and the winding frame, and run back of twists imparted by the twisting device can be done effectively, and thus, quality of the false-twist textured yarn which will be obtained can be good.

In addition, when the second heater is a heater which can be heated to a high temperature between 250 and 600° C., all of the twisting device, the feed rollers, and the second heater can be disposed in such a region that they can be serviced by an operator standing at the operator's aisle, and the winding devices on the winding frame can also be located in such a region that they can be serviced by an operator standing at the operator's aisle, and thus, the operator can readily perform operations, such as a threading operation without using a step.

As described above, many advantages can be achieved by the arrangement wherein the main frame is provided with the twisting devices and second heaters, the winding frame is provided with the winding devices, and the operator's aisle is disposed between the frames. However, the most serious problem inherent to this arrangement is that the operator has to bend for threading operation since the yarn from the main frame to the winding frame passes beneath the floor disposed at the operator's aisle.

Taking the problem inherent to such a conventional apparatus into consideration, it is an object of the present invention to provide an apparatus and method for threading a yarn onto a textile machine, especially false-twist texturing machine or draw false-twist texturing machine, by which an operator can perform threading operation around the operator's aisle without bending.

It is another object of the present invention to provide a threading apparatus by which threading operation onto a second heater heated at a temperature of between 250 and 600° C. without encountering any substantial problems.

Further, it is a still other object of the present invention to provide a threading apparatus by which threading operation onto a winding device can be done very easily.

DISCLOSURE OF THE INVENTION

According to the present invention, the above-described objects are achieved by a yarn threading apparatus in a textile machine comprising:

- a main frame provided with twisting devices and heaters disposed downstream of the twisting devices; and
- a winding frame facing the main frame sandwiching an operator's aisle therebetween and provided with winding devices, whereby a yarn leaving the heater disposed on the main frame is guided along the operator's aisle to the winding device disposed on the winding frame, characterized in that
- a yarn guide pipe is disposed extendably and retractably along the operator's aisle,
- a yarn feed roller device is so disposed that it locates at the yarn feeding position when the yarn guide is retracted and that it moves to a stand-by position when the guide pipe is extended, and
- a yarn feed tube provided with a yarn feed nozzle is disposed between the extended end of the yarn guide pipe and the winding device.

Further, the present invention achieves the objects by a yarn threading apparatus in a textile machine comprising:

- a main frame provided with twisting devices and heaters disposed downstream of the twisting devices; and
- a winding frame facing the main frame sandwiching an operator's aisle therebetween and provided with winding devices, whereby a yarn leaving the heater disposed on the main frame is guided beneath the operator's aisle to the winding device disposed on the winding frame, characterized in that
- the heater is provided with a yarn threading slit extending along a yarn passage, and
- a guide member which is engageable with and disengageable from the yarn prior to being threaded into the heater is disposed adjacent to the yarn threading slit, whereby while the yarn is guided from the guide member to the winding device passing beneath the operator's aisle, the yarn is disengaged from the guide member and is threaded into the heater through the yarn threading slit.

In this occasion, it is preferred that the guide member is a pipe with a spiral cross section which is disposed adjacent to the heater and which is provided with a yarn removing slit extending along the yarn passage.

Further, the present invention achieves the above-described objects by a yarn threading apparatus in a textile machine comprising:

a main frame provided with twisting devices and heaters disposed downstream of the twisting devices; and a winding frame facing the main frame sandwiching an operator's aisle therebetween and provided with winding devices, whereby a yarn leaving the heater disposed on the main frame is guided along the operator's aisle to the winding device disposed on the winding frame, characterized in that the heater is provided with a yarn threading slit extending along a yarn passage, a guide pipe member with a spiral cross section and provided with a yarn removing slit extending along the yarn passage is disposed adjacent to the yarn threading slit, and the member is engageable with and disengageable from the yarn prior to being threaded into the heater, a yarn guide pipe is disposed extendably and retractably along the operator's aisle, a yarn feed roller device is so disposed that it locates at the yarn feeding position when the yarn guide is retracted and that it moves to a stand-by position when the guide pipe is extended, and a yarn feed tube provided with a yarn feed nozzle is disposed between the extended end of the yarn guide pipe and the winding device.

In this occasion, it is preferred that the heater is a non-contact type high temperature heater which is capable of being heated at a temperature between 250 and 600° C.

Further, the present invention provide a yarn threading apparatus in a textile machine comprising:

a winding device and a threading device disposed in front of the winding device, characterized in that the threading device comprising:

a yarn feed tube provided with a yarn feed nozzle;

a guide member extending between a front end of the yarn feed tube and a position in front of the winding device; and a yarn guide bar locating between the guide member and the winding device and extending in a traversing direction of the winding device, and the guide member is provided with:

a bottom surface which extends from the front end of the yarn feed tube and an end of which opposite to the yarn feed tube is smoothly curved toward the winding device over the guide bar; and side walls projecting from both sides of the bottom surface towards the winding device.

The present invention may be a yarn threading apparatus in a textile machine comprising:

a main frame provided with twisting devices and heaters disposed downstream of the twisting devices, and threading devices disposed in front of the winding devices; and a winding frame facing the main frame sandwiching an operator's aisle therebetween and provided with winding devices, whereby a yarn leaving the heater disposed on the main frame is guided along the operator's aisle to the winding device disposed on the winding frame, characterized in that the heater is provided with a yarn threading slit extending along a yarn passage, a guide pipe member with a spiral cross section and provided with a yarn removing slit extending along the yarn passage is disposed adjacent to the yarn threading slit, and the member is engageable with and disengageable from the yarn prior to being threaded into the heater, a yarn guide pipe is disposed extendably and retractably along the operator's aisle, a yarn feed roller device is so disposed that it locates at the yarn feeding position when the yarn guide pipe is retracted and that it moves to a stand-by position when the guide pipe is extended, and a yarn feed tube provided with a yarn feed nozzle is disposed between the extended end of the yarn guide pipe and the winding device, and the threading device comprises:

a yarn feed tube provided with a yarn feed nozzle;

a guide member extending between a front end of the yarn feed tube and a position in front of the winding device; and a yarn guide bar locating between the guide member and the winding device and extending in a traversing direction of the winding device, and the guide member being provided with:

a bottom surface which extends from the front end of the yarn feed tube and an end of which opposite to the yarn feed tube is smoothly curved toward the winding device over the guide bar; and side walls projecting from both sides of the bottom surface towards the winding device.

In this occasion, it is preferred that the height of the side walls of the guide member increases from the front end of the yarn feed tube to another end opposite to the yarn feed tube so that yarn feed air jetted from the front end of the yarn feed tube via the yarn feed nozzle diverges as it moves away from the yarn feed tube so as to smoothly transfer the yarn.

It is also preferred that the front end of the yarn feed tube locates at a fulcrum of traverse motion of the winding device so that the traverse motion of the yarn which has been threaded is not disturbed.

Further, it is preferred that a suction device is disposed between the guide bar and the winding device so as to ensure the threading operation.

The present invention may be a yarn threading apparatus in a textile machine comprising:

a main frame provided with twisting devices and yarn feed rollers disposed downstream of the twisting devices; and a winding frame facing the main frame sandwiching an operator's aisle therebetween and provided with winding devices, whereby a yarn travels beneath the operator's aisle, characterized in that a guide pipe provided with a yarn feed nozzle is disposed along the operator's aisle, and a yarn feed tube provided with a yarn nozzle is disposed between an end of the guide pipe near the winding frame to the winding device, so that the yarn from the main frame is threaded onto the winding device.

In this occasion, it is preferred that the main frame has heaters mounted below the feed rollers, the heater is provided with a yarn threading slit extending along a yarn passage, and a guide member which is engageable with and disengageable from the yarn prior to being threaded into the heater is disposed adjacent to the yarn threading slit, and the guide member is provided with a slit through which the yarn is disengaged from the guide member so as to be threaded into the heater.

Further, the present invention provides a method for threading a yarn on a textile machine comprising:

a main frame provided with twisting devices and heaters disposed downstream of the twisting devices; and a winding frame facing the main frame sandwiching an operator's aisle therebetween and provided with winding devices, whereby a yarn leaving the heater disposed on the main frame is guided along the operator's aisle to the winding device disposed on the winding frame, the heater is provided with a yarn threading slit extending along a yarn passage, a guide pipe member having a spiral cross section and provided with a yarn removing slit extending along the yarn passage, which member is engageable with and disengageable from the yarn prior to being threaded into the heater is disposed adjacent to the yarn threading slit, a yarn guide pipe is disposed extendably and retractably along the operator's aisle, a yarn feed roller device is so disposed that it locates at the yarn feeding position when the yarn guide is retracted and that it moves to a stand-by position when the guide pipe is extended, and a yarn feed pipe provided with a yarn feed nozzle is disposed between the extended end of the yarn guide pipe and the winding device, characterized in that a yarn end is positioned at the entrance of the guide pipe member, and the yarn is guided by means of effect of the yarn feed nozzle from the guide pipe member to the winding device through the guide pipe, then, the yarn is disengaged from the guide pipe member through the yarn removing slit, and the thus disengaged yarn is threaded into the heater through the yarn threading slit.

It has been conventionally and partially done to thread a yarn into a heater formed in a completely tubular shape by means of a suction, for example, U.S. Pat. No. 3,999,360. However, when a yarn is threaded in such a heater with a completely tubular shape, if the threading operation is performed under the condition wherein the yarn is not forwarded while the heater is heated to a high temperature, yarn breakage occurs readily and threading operation fails. Accordingly, threading operation onto such a conventionally known heater having tubular shape can be carried out only when the temperature of the heater is relatively low.

Conventionally, a threading apparatus using suction has been known, for example French Patent Application Laid-open No. 2,695,631. However, such an apparatus has not been used to thread a yarn beneath the threading aisle formed between the main frame and the winding frame.

BRIEF DESCRIPTION OF THE DRAWINGS

Some embodiments of the present invention will now be explained in detail with reference to the attached drawings, wherein.

BEST MODE FOR CARRYING OUT THE INVENTION

Figure 1:
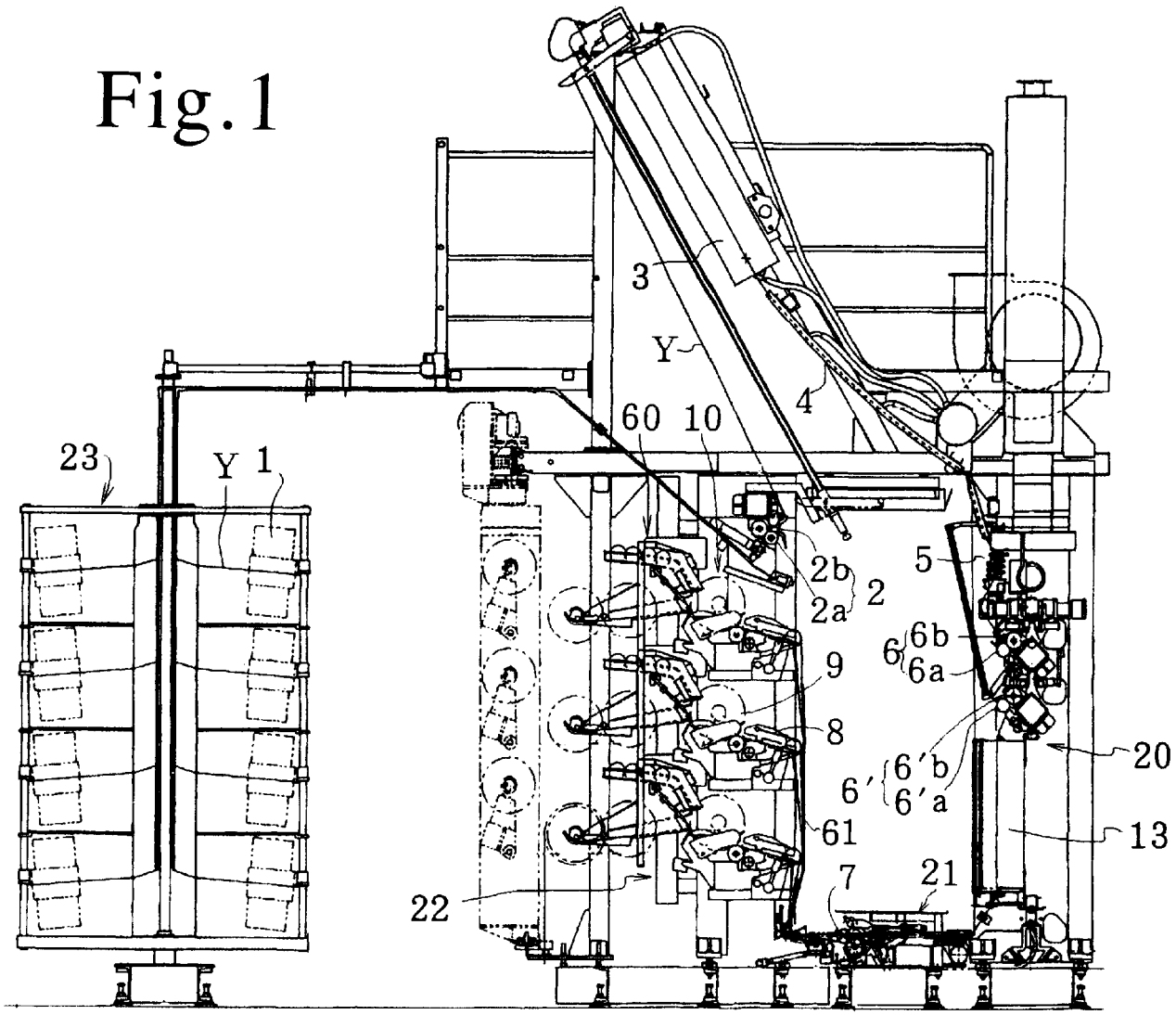
FIG. 1 is a diagrammatical elevation showing a half part of an embodiment of the draw false-twist texturing machine according to the present invention, and this draw false-twist texturing machine has heater devices, i.e., second heaters 13, for heat-treating a thermo-plastic synthetic yarn threading devices and so on mounted thereon, and the method for threading onto the draw false-twist texturing machine according to the present invention can be carried out therein.

FIG. 1 is a diagrammatical elevation showing a half part of an embodiment of the draw false-twist texturing machine according to the present invention, and at the right portion of FIG. 1, a main frame 20 having twisting devices 5 and second heaters 13 mounted thereon is illustrated, and a winding frame 22 having a plurality of winding devices 10 in a vertically multi-stages, three stages in this embodiment, is disposed spacing from the main frame 20, and an operator's aisle 21 is formed between the main frame and the winding frame 22. A creel frame 23 having a plurality of supply packages 1 mounted thereon is disposed at the left of the winding frame 22.

The winding frame 22 has first yarn feed roller devices 2, each comprising a pair of rollers 2*a* and 2*b*, mounted at the upper portion thereof. First heaters 3 inclined over the operator's aisle 21 formed between the main frame 20 and the winding frame 22, and stabilizing tracks 4 are disposed downstream of the first heaters 3.

The main frame 20 has second yarn feed roller devices 6, each comprising a pair of rollers 6*a* and 6*b*, mounted thereon between the twisting devices 5 and the second heaters 13. The first yarn feed roller device 2 and the second yarn feed roller device 6 are so set that they have peripheral speeds at a predetermined ratio therebetween, and a yarn Y is drawn at the predetermined ratio between the first yarn feed roller device 2 and the second yarn feed roller device 6.

The twisting device 5 mounted on the main frame 20 may be a conventionally known twisting device, such as of a friction belt type, a friction disk type, or a false-twisting spindle type, and impart twists to the yarn Y. In this embodiment, a third feed roller device 6' comprising a pair of rollers 6'*a* and 6'*b* is also disposed below the second feed roller device 6, however, if it is not required, the third feed roller device may be omitted.

Beneath the operator's aisle 21 formed between the main frame 20 and the winding frame 22, a fourth feed roller device 7 comprising a pair of rollers 7*a* and 7*b* (FIG. 2) is disposed.

The winding device 10 mounted on the winding frame 22 comprises: a traverse device 8 which comprises a fulcrum of the traverse motion and a traverse guide and which traverse a yarn Y to and fro; a bobbin holder onto which a yarn winding bobbin is inserted; and a friction roller 9 which is pressed to the bobbin or the yarn wound on the bobbin. Each winding device 10 is provided with an individual doffing device 60 for doffing a wound package. Accordingly, a fully wound package is automatically doffed at each operating station, and is transferred to a side opposite to the operator's aisle, and then an empty bobbin is donned onto the bobbin holder.

Under normal operating conditions, a yarn Y is withdrawn by means of the first yarn feed roller device 2 from a supply package 1 mounted on the creel frame 23, and while the yarn Y is drawn at a predetermined draw ratio between the first and second yarn feed devices 2 and 6, twists are imparted to the yarn Y by the twisting device 5. The draw false-twist texturing machine according to the present invention may be of a type wherein a yarn may be false-twisted after it is drawn in stead of a type wherein a yarn is simultaneously drawn and false-twisted.

Twists imparted to the yarn Y by means of the twisting device 5 run back along the yarn Y towards the first yarn feed device 2. The twists run back along the yarn Y are heat set at the first heater 3, and the yarn Y is cooled at the stabilizing track 4 disposed downstream of the first heater 3.

Thus, between the first yarn feed roller device 2 and the second yarn feed roller device 6, false-twists are imparted to the yarn Y upstream of the twisting device 5, and the yarn Y which has been fully cooled at the stabilizing track 4 enters into the twisting device 5. The yarn Y leaving the twisting device 5 is detwisted, and crimps of the yarn Y are adjusted at the second heater 13 disposed below the twisting device 5. The yarn Y is forwarded from the second feed roller device 6 under the operator's aisle 21, and then it is fed to the winding device 10 mounted on the winding frame 22 through the fourth yarn feed roller device 7.

At the winding device 10, the yarn Y is wound on the bobbin to form a package, the fully wound package at each winding station is automatically doffed by means of the individual doffing apparatus 60, and then an empty bobbin is donned The second heater 13 according to the present invention and the threading device for threading therein will now be explained. The second heater 13 according to the present invention is a non-contact type high temperature heater which can be heated to a temperature of between 250 and 600° C. No-contact type means that a yarn does not substantially contact with the wall while it runs therein, however, if it is required, yarn guides may be disposed at a predetermined pitch.

Figure 3:
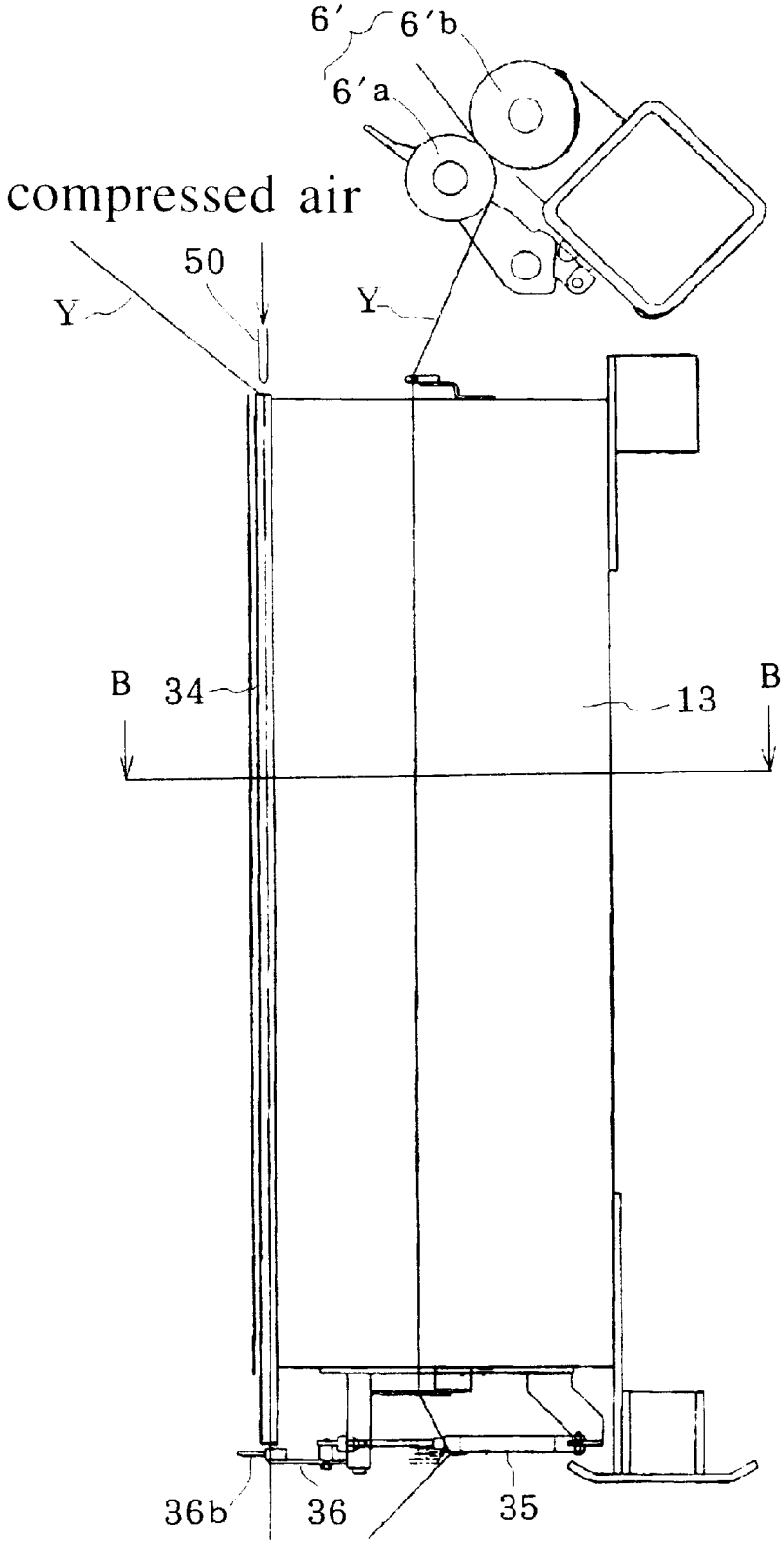
FIG. 3 is a side view of an embodiment of a heat treating device, i.e., the second heater, according to the present invention.
Figure 4A:
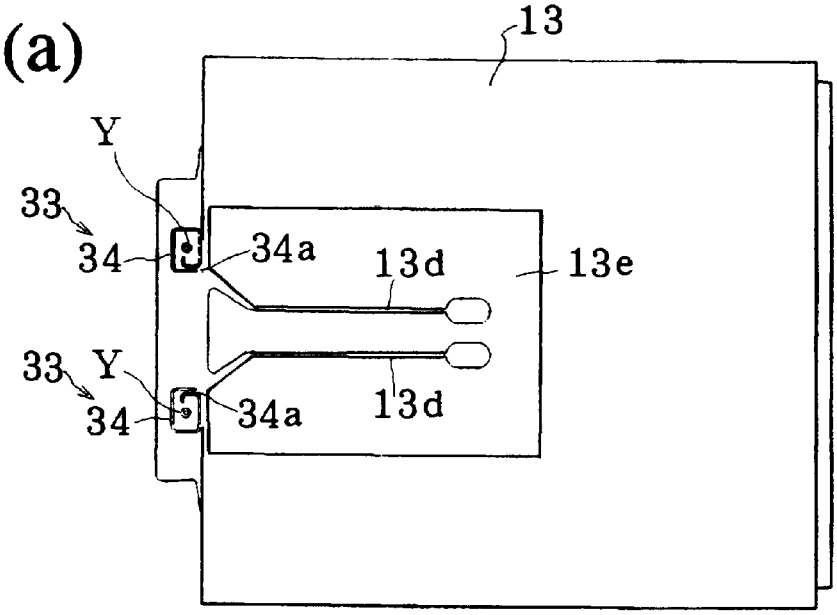
FIG. 4 shows the embodiment of the heat treating device, i.e., the second heater, according to the present invention, wherein (a) is a plan view, (b) is a cross sectional view taken along line B—B in FIG. 3, and (c) is an enlarged plan view of a yarn guide pipe member.
Figure 4B:
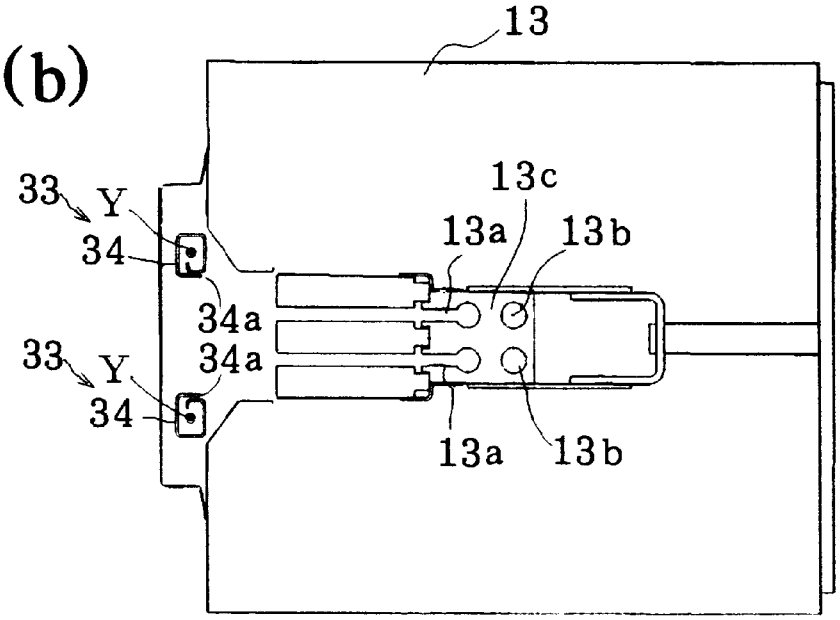
Figure 4C:
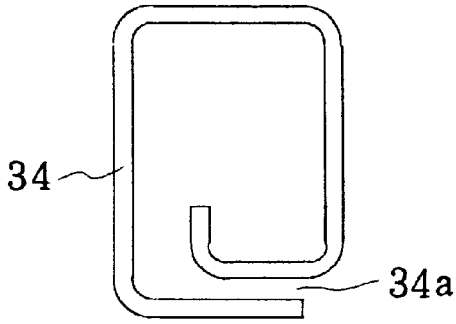

FIGS. 3 and 4 show an embodiment of the second heater 13, wherein FIG. 3 is a side view of the second heater, FIG. 4(*a*) is a plan view of the second heater illustrated in FIG. 3, FIG. 4(*b*) is a cross sectional view taken along line B—B in FIG. 3, and FIG. 4(*c*) is an enlarged plan view of a yarn guide pipe member 34.

In the non-contact type high temperature second heater 13 of this embodiment, two yarns Y are heated, and as illustrated in FIG. 4(*b*), a heater block 13*c* which is heated by sheath heaters 13*b* has two yarn passages and threading slits 13*a* extending along the yarn running direction and formed between the yarn passages and outside. Further, as illustrated in FIG. 4(*a*), the second heater 13 has at the top surface thereof an upper yarn guide plate 13*e* having guide grooves 13 formed at positions corresponding to the threading slits 13*a*. Thus, a yarn Y can be threaded onto the second heater 13 through the threading slit 13*a*.

When a yarn Y which is not in a running condition is threaded onto the second heater 13 which is heated at a high temperature, yarn breakage may easily occur since the second heater is heated at an extremely high temperature. Thus, it is necessary to thread onto the high temperature second heater 13 after the yarn reaches a predetermined speed. For such purpose, the high temperature second heater 13 of this embodiment has threading slit 13*a*.

A guide member 33 which guides a yarn Y upon threading operation is disposed adjacent to the threading slit 13*a* of the second heater 13. The guide member 33 of this embodiment is a guide pipe member 34 which has a spiral cross section as illustrated in FIG. 4(*c*), and a part of the guide pipe member 34 formed in a spiral cross section forms a slit 34*a* for removing the yarn Y therethrough. The directions of a pair of spirals are opposite , i.e., one in a clock-wise and the other in a counter-clockwise, and the yarn removing slits 34 are facing the center of the yarn passages formed by a pair of the guide members 34. The yarn removing slit 34*a* extends along a yarn passage.

At a position downstream of the heat treating apparatus, i.e., the second heater 13, disposed is a member which engages with the yarn Y running inside of the guide pipe member 34 so as to disengage the yarn Y from the guide pipe member 34 through the yarn removing slit 34*a*, and which then threads the yarn Y onto the heat treating apparatus, i.e., the second heater 13, through the threading slit 13*a*.

Figure 5:
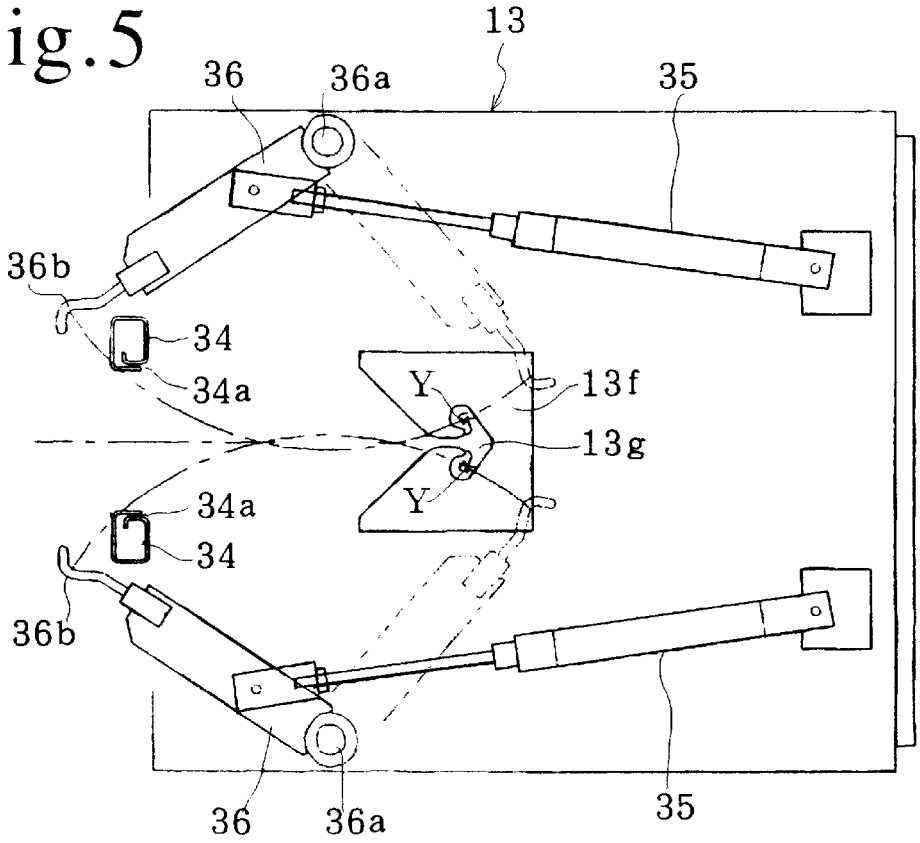
FIG. 5 is an enlarged elevation showing the lower part of the draw false-twist texturing machine illustrated in FIG. 1.

More specifically, as illustrated in FIG. 5, a yarn removing lever 36 is disposed swingably about a pin 36*a* at a position downstream of the second heater 13, the yarn removing lever 36 is swung about the pin 36*a* by means of a pneumatic cylinder 35. Accordingly, a yarn guide 36*b* attached at an end of the yarn removing lever 36 opposite to the pin 36*a* engages with the yarn Y running inside of the guide pipe member 34 and it pushes the yarn Y to the outside through the yarn removing slit 34*a* while it holds the yarn Y at the hooked portion thereof. Then, the yarn guide 36*b* of the yarn removing lever 36 threads the yarn into the second heater 13. An outlet guide 13*f* disposed at the outlet portion of the second heater 13 has a hole 13*g* formed in a spade shape as illustrated in FIG. 5. The yarn Y which has been pushed out from the yarn guide member 34 due to the swinging operation of the yarn guide 36*b* is moved from the central portion of the spade shaped hole 13*g* to either one of the side portions of the spade shaped hole 13*g* as the yarn guide 36*b* swings to a position illustrated by a broken line. Thereafter, the yarn guide 36*b* returns to the original position. As a result, the yarn Y is held within the spade shaped hole 13*g* due to tension in the yarn Y.

Figure 2:
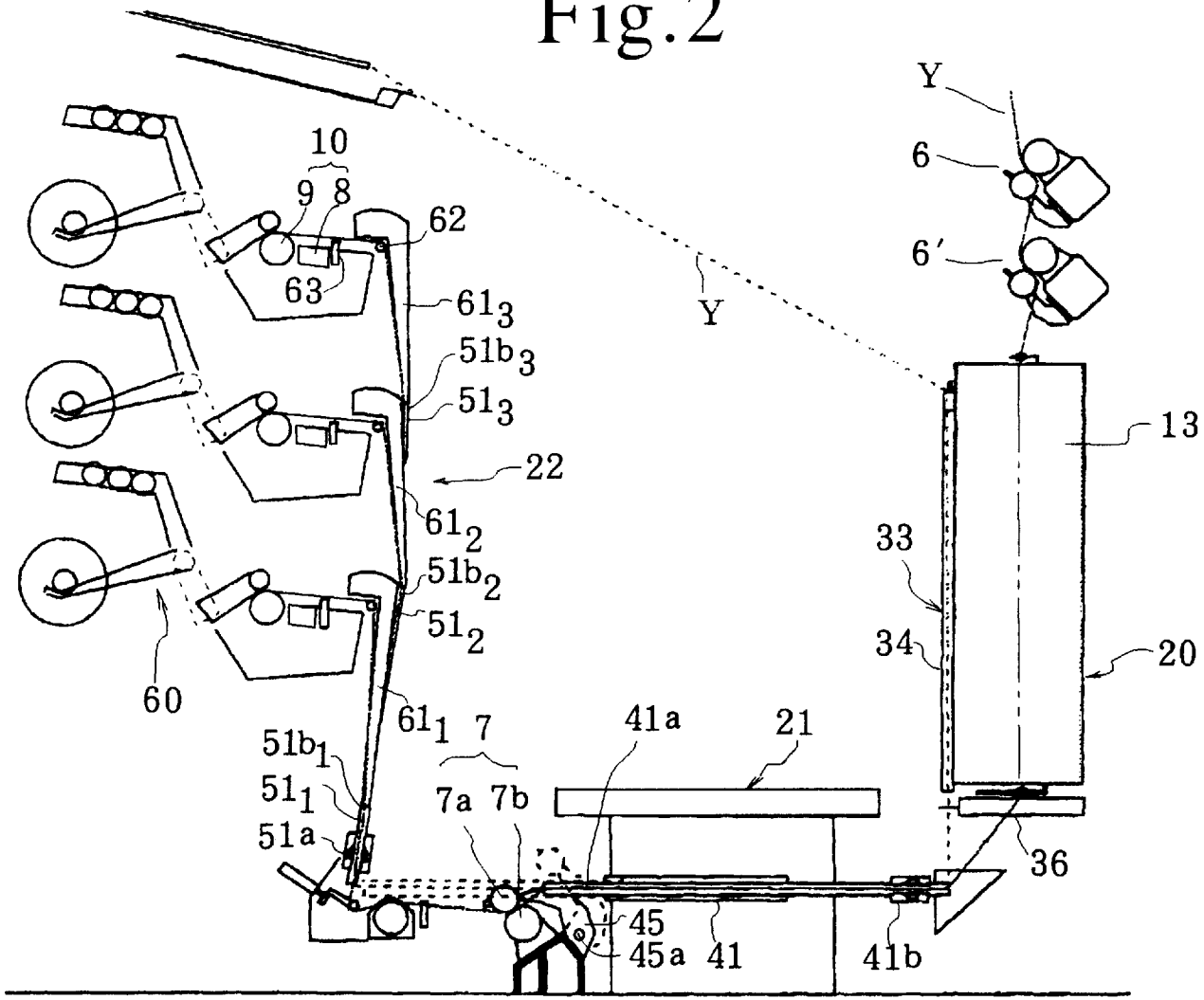
FIG. 2 is a diagrammatical elevation showing the lower part of the draw false-twist texturing machine illustrated in FIG. 1.

As illustrated in FIG. 2, a yarn guide pipe 41 is disposed beneath the operator's aisle 21 formed between the main frame 20 and the winding frame 22. The yarn guide pipe 41 has a yarn feed nozzle 41*b* mounted at the base portion, i.e., the right portion in FIGS. 1, 2 and 6, thereof, and a front end of the yarn guide pipe 41 is formed in a double tube. The yarn feed nozzle 41*b* may be of a conventionally known suction type. The front part 41*a* of the double tube can be extended and retracted by means of an actuator 43 (see FIG. 7) such as a pneumatic cylinder which surrounds the front part 41*a*. Although under the normal operational conditions, the length of the yarn guide 41 is that between the main frame 20 and a position near the fourth yarn feed roller device 7, under the threading operational conditions, the front end 41*a* locating near the fourth yarn feed roller device 7 can be extended over the position where the fourth yarn feed roller device 7 is disposed toward a position near the entrance of the winding frame 22.

A pressing roller 7*a* of the fourth yarn feed roller 7 locates at a position illustrated in a solid line in FIG. 2 under the normal operational conditions, however, under the threading operational conditions, since the yarn guide pipe 41 extends, the pressing roller 7*a* of the fourth yarn feed roller 7 moves to a stand-by position illustrated by a broken line in FIG. 2 so that it does not disturb the extension.

Figure 6:
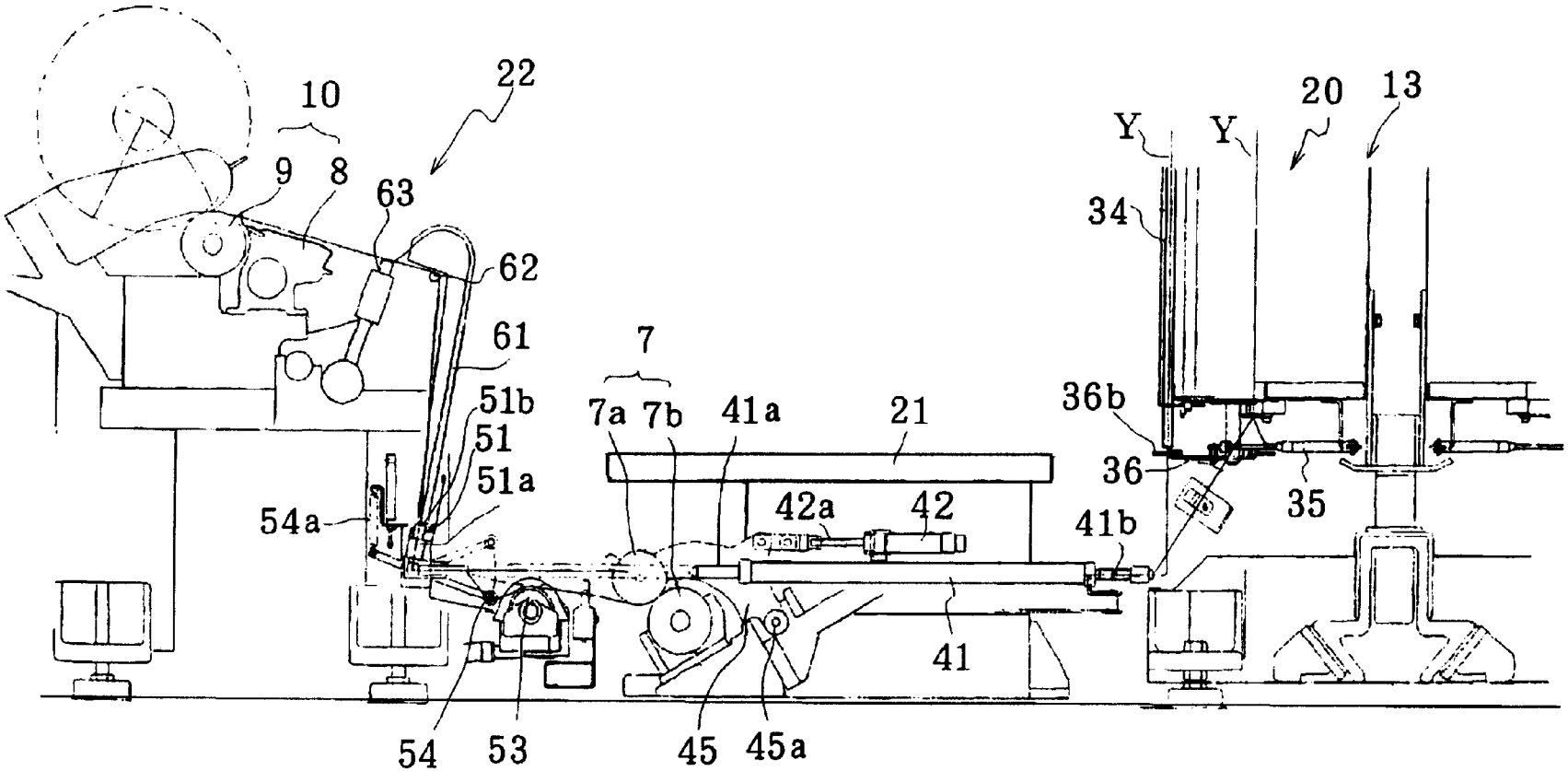
FIG. 6 is a detailed view of FIG. 2.
Figure 7:
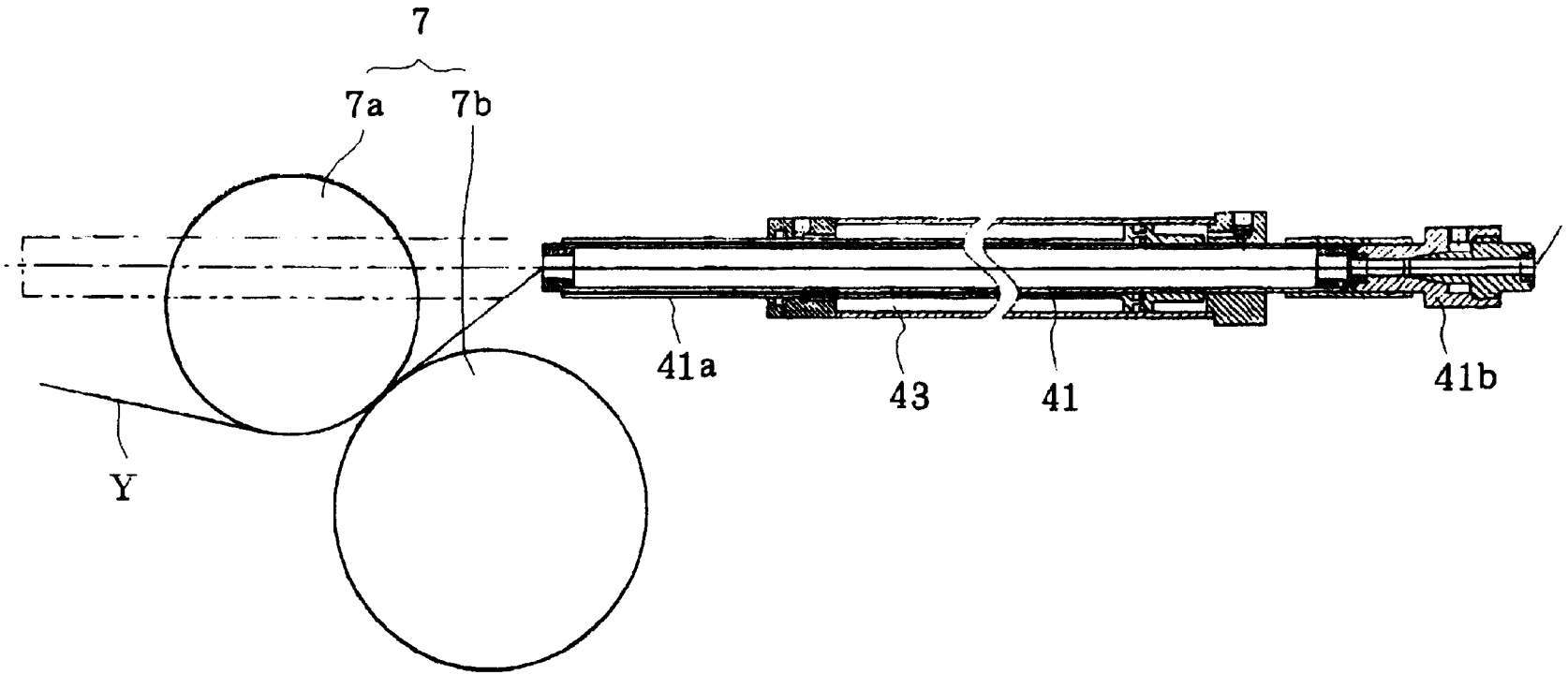
FIG. 7 is a cross sectional view of a yarn guide pipe.

More specifically, as illustrated in FIGS. 2 and 6, an arm 45 having the pressing roller 7*a* of the fourth yarn feed roller device 7 rotatably mounted thereon is swingably pivoted around a pin 45*a*, and the pressing roller mounting arm 45 is connected by means of a pin to a rod 42*a* of an actuator 42 (see FIG. 6) which operates substantially in synchronism with the above-described actuator 43 (see FIG. 7) for operating the yarn guide pipe 41. Because of this construction, the movement to the stand-by position and returning movement from the stand-by position to the original position of the pressing roller 7*a* of the fourth yarn feed roller device 7*a* are performed by the actuators 42 and 43 simultaneous with and synchronism with the extension and retraction of the yarn guide pipe 41.

Further, yarn feed tube 51 provided with a yarn feed nozzle 51*a* mounted therein is disposed between the lower portion of the winding frame 22 to the winding device 10. The yarn feed nozzle 51*a* may be of a conventionally known suction type. The yarn feed tube 51 is a part of the threading device for threading a yarn onto the winding device 10. The threading device for threading a yarn Y onto the winding device 10 will now be explained with reference to FIGS. 9 and 10.

Figure 10:
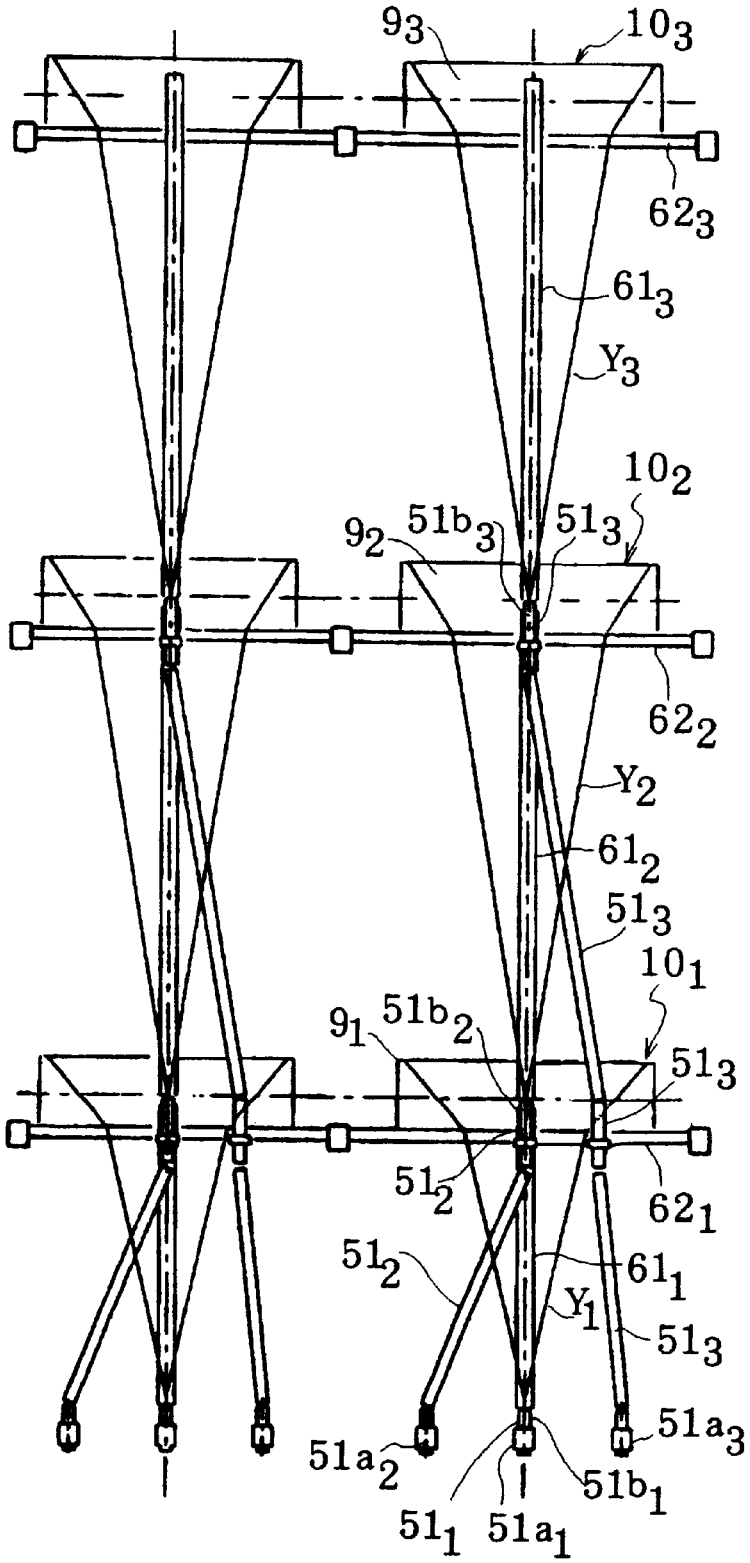
FIG. 10 is an elevation of the winding frame.

As illustrated in FIGS. 1 and 2, the winding frame 22 has winding devices 10 vertically disposed in three stages. As illustrated in FIG. 10 , wherein suffix 1 denotes the lower stage, suffix 2 denotes the middle stage and suffix 3 denotes the upper stage, three yarn feed nozzles 51*a* which individually forward the yarns Y to the winding devices 10 disposed on the corresponding stages are disposed in parallel on a substantially horizontal line at a lower position of the winding device 10 disposed on the lower stage. Among the three yarn feed nozzles 51*a*, the yarn feed nozzle $\mathbf{51}a_2$ which is disposed at the left in FIG. 10 forwards the yarn Y to the winding device 102 disposed on the middle stage, the yarn feed nozzle $\mathbf{51}a_1$ which is disposed at the center forwards the yarn Y to the winding device $\mathbf{10}_1$ disposed on the lower stage, and the yarn feed nozzle $\mathbf{51}a_3$ which is disposed at the right forwards the yarn Y to the winding device $\mathbf{10}_3$ disposed on the upper stage. The yarn feed tubes 51 ($\mathbf{51}_1$, $\mathbf{51}_2$ and $\mathbf{51}_3$) extend from the corresponding yarn feed nozzles 51*a* ($\mathbf{51}a_1$, $\mathbf{51}a_2$ and $\mathbf{51}a_3$) to the lower positions in front of the corresponding winding devices 10 ($\mathbf{10}_1$, $\mathbf{10}_2$ and $\mathbf{10}_3$). The front ends 51*b* ($\mathbf{51}b_1$, $\mathbf{51}b_2$ and $\mathbf{51}b_3$) of the yarn feed tubes 51 ($\mathbf{51}_1$, $\mathbf{51}_2$ and $\mathbf{51}_3$) are positioned at the fulcrums of the corresponding traverse devices 8 of the winding devices 10 so that the traverse motion of the yarn after threading operation is controlled.

Figure 9:
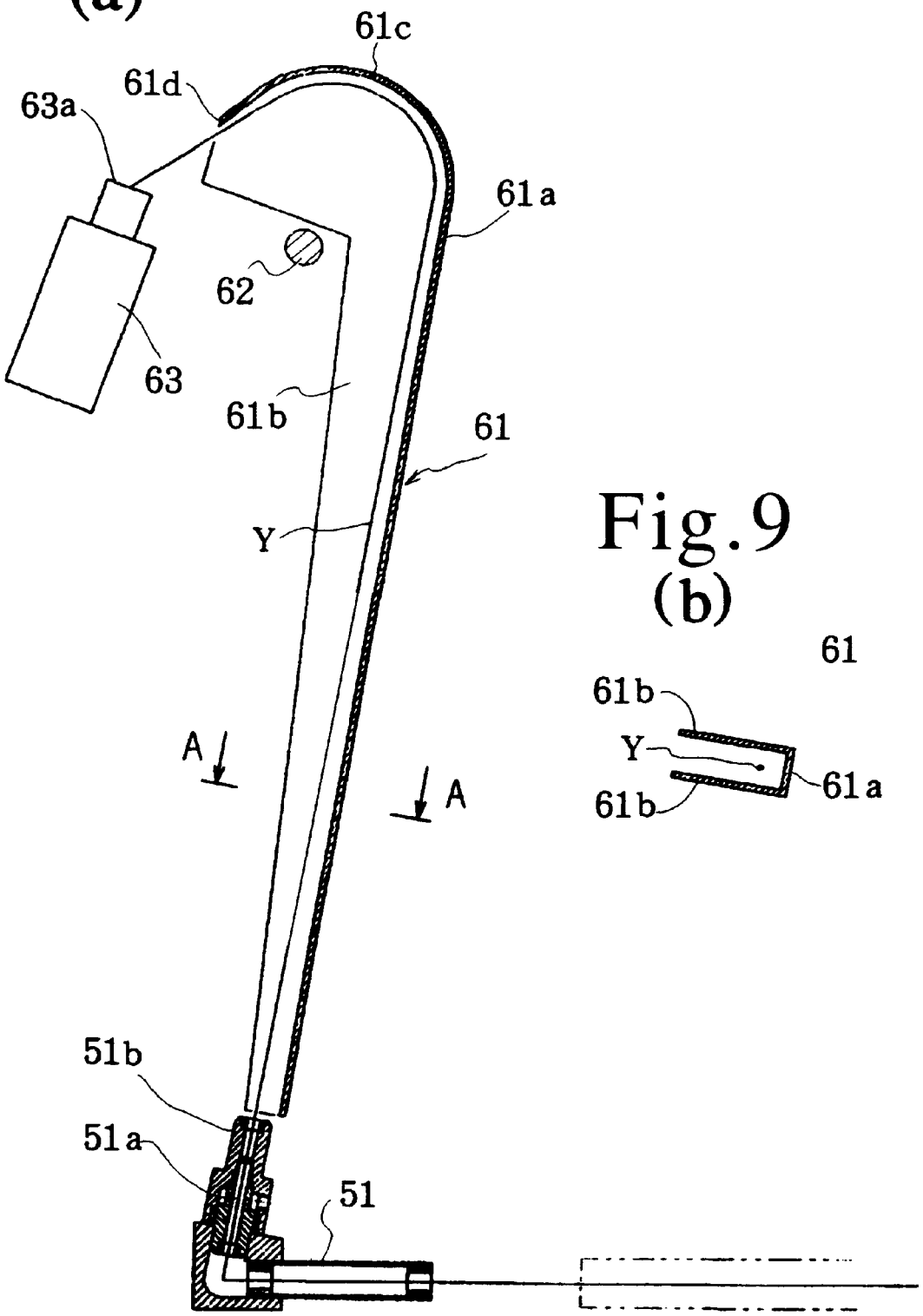
FIG. 9 shows a threading device for threading onto a winding device located on the lower stage, wherein (a) is a cross sectional view, and (b) is a cross sectional view taken along line A—A.

FIG. 9 shows a threading device for threading onto a winding device 10 located on the lower stage. A guide member 61 extends between the front end 51*b* of the yarn feed tube 51 and a position in front of the winding device 10. Further, a yarn guide bar 62 extends in a traversing direction, i.e., a direction perpendicular to the sheet on which FIG. 9 is drawn and a direction parallel to the sheet on which FIG. 9 is drawn, of the traverse device 8 of the winding device 10 at a position between the guide member 61 and the winding device 10.

In FIG. 9, the guide member 61 is provided with a bottom surface 61*a* and side walls 61*b* projecting from the sides of the bottom surface 61*a*. The bottom surface 61*a* is upwardly inclined substantially along a straight line from the front end 51*b* of the yarn feed tube 51 to the right of the yarn guide bar 62, and an end 61*c*, i.e., the upper end in FIG. 9, opposite to the end facing the yarn feed tube 51 and extending across the yarn guide bar 62 is smoothly curved along an arc towards the winding device 10, and its end 61d arrives at the left of the yarn guide bar 62, and thus, the bottom surface 61*a* as a whole provides a reverse J-shaped cross section. The side walls 61*b* project from the sides of the bottom surface 61*a* toward the winding device 10. Thus, the guide member 61 has a U-shaped cross section as illustrated in FIG. 9(*b*). The height of the side walls 61*b* of the guide member 61 increases from the end 51*b* facing the yarn feed nozzle 51*a* of the yarn feed tube 51 to the other end 61*c* opposite to the yarn feed tube 51, and thus, yarn feed air jetted from the front end of the yarn feed tube 51 through the yarn feed nozzle 51*a* gradually diverges as it moves away from the yarn feed tube 51, and the yarn Y is smoothly transferred without causing flying out. A suction device 63 is disposed in such a manner that the suction mouth 63*a* thereof is located at a position between the guide bar 62 and the winding device 10 and substantially on an extension of the bottom surface of the guide member 61. The suction device 63 may be of a conventionally known type.

In FIG. 6, an oil applicator roll 53 is disposed between the fourth yarn feed roller device 7 and the lower end of the yarn feed tube 51, and a yarn pressing guide 54 presses a yarn Y on the oil applicator roller 53. The yarn pressing guide 54 is urged to the oil applicator roller 53 as illustrated by a solid line in FIG. 6 by means of a spring 54*a* under the normal conditions, and when the front end 41*a* of the yarn guide pipe 41 extends, as illustrated by a dot-and-dash line in FIG. 6, it is lifted.

The threading operation in the above-described embodiment will now be explained. Prior to the threading operation, as illustrated by a broken line in FIG. 2, the yarn guide pipe 41 disposed beneath the operator's aisle 21 is extended, and the fourth yarn feed roller device 7 is moved to the stand-by position. Accordingly, the yarn guide pipe 41 and the yarn feed tube 51 form a series of substantially continued passage.

Figure 8:
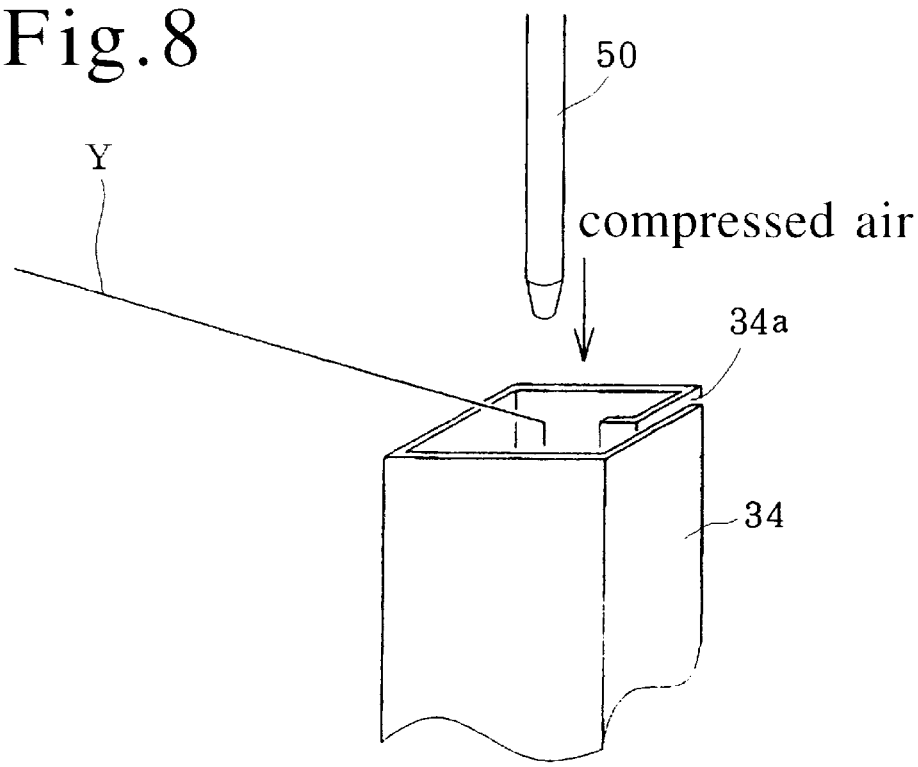
FIG. 8 is a perspective view illustrating threading steps into a guide pipe member.

Under the conditions, upon threading, the yarn Y withdrawn form the supply package 1, which is mounted on the creel frame 23 illustrated in FIG. 1, is guided to a position above the yarn guide pipe member 34, which is disposed adjacent to the yarn threading slit 13*a* of the second heater 13, without passing it through the first heater 3 or the twisting device 5 as illustrated by a broken line in FIG. 2. Under the conditions, as illustrated in FIG. 8, the yarn Y is jetted into the guide pipe 34 from the above thereof together with compressed air by means of an air nozzle 50. The end of the yarn Y passing through the guide pipe member 34 arrives at the entrance of the yarn guide pipe 41, and the yarn Y passes through the yarn guide pipe 41 by means of the yarn feed nozzle 41*a* to the entrance of the yarn feed tube 51, and then the yarn Y is transferred due to the effect of the yarn feed nozzle 51*a* of the yarn feed tube 51 to the winding device 10 and is threaded thereonto as described later (see the broken line in FIG. 2).

The threading steps after threading onto the yarn guide pipe member 34 will now be explained. Under the conditions, wherein threading onto the yarn guide pipe member 34 disposed adjacent to the second heater 13 has been completed, an operator threads the yarns Y, which are connected between the supply packages 1 mounted on the creel frame 23 and the yarn guide pipe members 34, one by one onto the first heaters 3 and the twisting devices 5 by means of a threading tool (see FIG. 1).

Under the conditions wherein threading onto the first heater 3 and the twisting device 5 has been completed, the pneumatic cylinder 35 (FIGS. 3 and 5) disposed downstream of the second heater 13 is actuated so that the yarn Y is disengaged from the guide pipe member 34 through the yarn removing slit 34*a*. The disengaged yarn Y is threaded into the second heater 13 through the yarn threading slit 13*a* of the second heater 13 (see FIG. 6). Since the yarn Y which is being transferred to the winding device 10 is threaded into the second heater 13, the yarn can readily be threaded into the second heater 13 without causing yarn breakage. In the first heater 3, which may be a high temperature second heater 13, the yarn Y is threaded while it is being travelled as described above, the threading operation can be smoothly done without causing yarn breakage.

Then, the yarn Y, which has left the second heater 13, passes through the extended yarn guide pipe 41 (FIGS. 2 and 6), and it is fed to the guide member 61 together with compressed air through the yarn feed tube 51, which is provided with the yarn feed nozzle 51*a* and which is mounted on the winding frame 22. The yarn Y is guided together with compressed air along the bottom surface 61*a* of the guide member 61 which has a reverse J-shaped cross section, and it is guided along the smooth curve formed at the front end 61*c* (the upper end in FIG. 9), opposite to the yarn feed tube 51, over a position above the guide bar 62 to a position beside the winding device 10. In this occasion, since the height of the side walls 61*b* of the guide member 61 increases from the end near the yarn feed tube 51 to the front end opposite to the yarn feed tube 51, yarn feeding air jetted from the end of the yarn feed tube 51 through the yarn feed nozzle 51*a* diverges gradually as it moves away from the yarn feed tube 51, and the yarn Y is smoothly transferred without causing flying out from the yarn guide member 61. The yarn Y is caught by the suction mouth 63*a* of the suction device 63 which is disposed between the guide bar 62 and the winding device 10. When the yarn Y caught by the suction device 63 is threaded automatically or manually onto the winding device 10, the yarn Y is traversed by means of the traverse device 8, wherein, as illustrated by a fan shape in FIG. 10, the front end 51*b* of the yarn feed tube 51 is a fulcrum of the traverse motion and the yarn Y is traversed to and fro along the guide bar 62, and the yarn Y is wound up through the friction roller 9.

Thereafter, the actuators 42 and 43 retract the yarn guide pipe 41 and at the same time urge the pressing roller 7*a* of the fourth yarn feed roller device 7 to the roller 7*b* disposed on the fixed portion, and then, normal operation starts.

In the above-described explanation, after a yarn is threaded onto the second heater 13, it is threaded onto the winding device 10 so that a yarn under normal conditions is wound onto a bobbin. However, in some cases, prior to the threading onto the second heater 13, a yarn may be threaded onto the winding device 10.

Further, in the above-described explanation, the yarn guide pipe 41 is disposed beneath the operator's aisle 21. According to the present invention, since a yarn leaving the yarn guide pipe 34 is guided into the yarn guide pipe 41, the travel of the yarn is not disturbed if the yarn guide pipe 41 is disposed along the operator's aisle 21 at a position near its floor. Accordingly, the yarn guide pipe is not required to be disposed beneath the operator's aisle 21. However, it is preferred that the yarn guide pipe is disposed beneath the operator's aisle 21 so that walk of an operator on the operator's aisle 21 becomes easier.

INDUSTRIAL UTILITY

According to the present invention, an operator can readily thread a yarn without bending upon threading operation from the second feed roller device 6 to the winding device 10, and operational efficiency of the operator is extremely enhanced, and further, time required for threading operation can be shortened due to enhancement of the operational efficiency, and amount of waste yarn can be reduced.

Further, the present invention provide a threading apparatus by which threading operation onto a second heater heated at a temperature between 250 and 600° C. without encountering any substantial problems, and working environment of an operator is improved.

Still further, according to the present invention, a threading apparatus is provided by which threading operation onto a winding device can be done very easily.

What is claimed is:

1. A yarn threading apparatus in a textile machine comprising:

a main frame provided with twisting devices and heaters disposed downstream of said twisting devices; and a winding frame facing said main frame sandwiching an operator's aisle therebetween and provided with winding devices, whereby a yarn leaving the heater disposed on said main frame is guided along said operator's aisle to the winding device disposed on said winding frame, characterized in that a yarn guide pipe is disposed extendably and retractably along said operator's aisle, a yarn feed roller device is so disposed that it locates at the yarn feeding position when said yarn guide is retracted and that it moves to a stand-by position when said guide pipe is extended, and a yarn feed tube provided with a yarn feed nozzle is disposed between the extended end of said yarn guide pipe and said winding device.

2. A yarn threading apparatus according to claim 1, characterized in that said heater is a non-contact type high temperature heater which is capable of being heated at a temperature between 250 and 600° C.

3. A yarn threading apparatus in a textile machine comprising:

a main frame provided with twisting devices and heaters disposed downstream of said twisting devices; and a winding frame facing said main frame sandwiching an operator's aisle therebetween and provided with winding devices, whereby a yarn leaving the heater disposed on said main frame is guided beneath said operator's aisle to the winding device disposed on said winding frame, characterized in that said heater is provided with yarn threading slit extending along a yarn passage, and a guide member which is engageable with and disengageable from said yarn prior to being threaded into said heater is disposed adjacent to said yarn threading slit, whereby while the yarn is guided from said guide member to said winding device passing beneath said operator's aisle, said yarn is disengaged from said guide member and is threaded into said heater through said yarn threading slit.

4. A yarn threading apparatus according to claim 3, characterized in that said guide member is a pipe with a spiral cross section which is disposed adjacent to said heater and which is provided with a yarn removing slit extending along the yarn passage.

5. A yarn threading apparatus in a textile machine comprising:

a main frame provided with twisting devices and heaters disposed downstream of said twisting devices; and a winding frame facing said main frame sandwiching an operator's aisle therebetween and provided with winding devices, whereby a yarn leaving the heater disposed on said main frame is guided along said operator's aisle to the winding device disposed on said winding frame, characterized in that said heater is provided with a yarn threading slit extending along a yarn passage, a guide pipe member with a spiral cross section and provided with a yarn removing slit extending along the yarn passage is disposed adjacent to said yarn threading slit, and said member is engageable with and disengageable from said yarn prior to being threaded into said heater, a yarn guide pipe is disposed extendably and retractably along said operator's aisle, a yarn feed roller device is so disposed that it locates at the yarn feeding position when said yarn guide is retracted and that it moves to a stand-by position when said guide pipe is extended, and a yarn feed tube provided with a yarn feed nozzle is disposed between the extended end of said yarn guide pipe and said winding device.

6. A yarn threading apparatus according to claim 5, characterized in that a member is disposed downstream of said heater which member engages with the yarn running inside of said guide pipe member, which member disengages said yarn from said guide pipe member through said yarn removing slit and which member threads said yarn into said heater through said yarn threading slit.

7. A yarn threading apparatus according to claim 1 or 4, characterized in that said yarn guide pipe is provided with a yarn feed nozzle.

8. A yarn threading apparatus in a textile machine comprising:

a winding device and a threading device disposed in front of said winding device, characterized in that said threading device comprises:

a yarn feed tube provided with a yarn feed nozzle;

a guide member extending between a front end of said yarn feed tube and a position in front of said winding device; and a yarn guide bar locating between said guide member and said winding device and extending in a traversing direction of said winding device, and said guide member is provided with:

a bottom surface which extends from said front end of said yarn feed tube and an end of which opposite to said yarn feed tube is smoothly curved toward said winding device over said guide bar; and side walls projecting from both sides of said bottom surface towards said winding device, wherein the height of said side walls of said guide member increases from said front end of said yarn feed tube to another end opposite to said yarn feed tube.

9. A yarn threading apparatus according to claim 8, characterized in that said front end of said yarn feed tube locates at a fulcrum of traverse motion of said winding tube.

10. A yarn threading apparatus according to claim 8, characterized in that a suction device is disposed between said guide bar and said winding device.

11. A yarn threading apparatus in a textile machine comprising:

a main frame provided with twisting devices and heaters disposed downstream of said twisting devices; and a winding frame facing said main frame sandwiching an operator's aisle therebetween and provided with winding devices and threading devices disposed in front of said winding devices, whereby a yarn leaving the heater disposed on said main frame is guided along said operator's aisle to said winding device disposed on said winding frame, characterized in that said heater is provided with a yarn threading slit extending along a yarn passage, a guide pipe member with a spiral cross section and provided with a yarn removing slit extending along the yarn passage is disposed adjacent to said yarn threading slit, and said member is engageable with and disengageable from said yarn prior to being threaded into said heater, a yarn guide pipe is disposed extendably and retractably along said operator's aisle, a yarn feed roller device is so disposed that it locates at the yarn feeding position when said yarn guide pipe is retracted and that it moves to a stand-by position when said guide pipe is extended, and a yarn feed tube provided with a yarn feed nozzle is disposed between the extended end of said yarn guide pipe and said winding device, and said threading device comprises:

a yarn feed pipe provided with a yarn feed nozzle;

a guide member extending between a front end of said yarn feed tube and a position in front of said winding device; and a yarn guide bar locating between said guide member and said winding device and extending in a traversing direction of said winding device, and said guide member being provided with:

a bottom surface which extends from said front end of said yarn feed tube and an end of which opposite to said yarn feed tube is smoothly curved toward said winding device over said guide bar; and side walls projecting from both sides of said bottom surface towards said winding device.

12. A yarn threading apparatus according to claim 11, characterized in that the height of said side walls of said guide member increases from said front end of said yarn feed tube to another end opposite to said yarn feed tube.

13. A yarn threading apparatus in a textile machine comprising:

a main frame provided with twisting devices and yarn feed rollers disposed downstream of said twisting devices; and a winding frame facing said main frame sandwiching an operator's aisle therebetween and provided with winding devices, whereby a yarn travels beneath said operator's aisle, characterized in that said main frame has heaters mounted below said feed rollers, characterized in that the heater is provided with yarn threading slit extending along a yarn passage, and a guide member which is engageable with and disengageable from said yarn prior to being threaded into said heater is disposed adjacent to said yarn threading slit, and said guide member is provided with a slit through which said yarn is disengaged from said guide member so as to be threaded into said heater; and a guide pipe provided with a yarn feed nozzle is disposed along said operator's aisle, and a yarn feed tube provided with a yarn nozzle is disposed between an end of said guide pipe near the winding frame to the winding device, so that the yarn from said main frame is threaded onto the winding device.

14. A method for threading a yarn on a textile machine comprising:

a main frame provided with twisting devices and heaters disposed downstream of said twisting devices; and a winding frame facing said main frame sandwiching an operator's aisle therebetween and provided with winding devices, whereby a yarn leaving the heater disposed on said main frame is guided along said operator's aisle to the winding device disposed on said winding frame, wherein said heater is provided with a yarn threading slit extending along a yarn passage, a guide pipe member having a spiral cross section and provided with a yarn removing slit extending along the yarn passage, which member is engageable with and disengageable from said yarn prior to being threaded into said heater is disposed adjacent to said yarn threading slit, a yarn guide pipe is disposed extendably and retractably along said operator's aisle, a yarn feed roller device is so disposed that it locates at the yarn feeding position when said yarn guide is retracted and that it moves to a stand-by position when said guide pipe is extended, and a yarn feed pipe provided with a yarn feed nozzle is disposed between the extended end of said yarn guide pipe and said winding device, characterized in that a yarn end is positioned at the entrance of said guide pipe member, and the yarn is guided by means of effect of said yarn feed nozzle from said guide pipe member to said winding device through said guide pipe, then, said yarn is disengaged from said guide pipe member through said yarn removing slit, and the thus disengaged yarn is threaded into said heater through said yarn threading slit.

* * * * *